US010130545B2

(12) United States Patent
Crowley et al.

(10) Patent No.: US 10,130,545 B2
(45) Date of Patent: Nov. 20, 2018

(54) LEG LIFTER

(71) Applicants: Richard J. Crowley, Estero, FL (US); Elizabeth A. Crowley, Estero, FL (US)

(72) Inventors: Richard J. Crowley, Estero, FL (US); Elizabeth A. Crowley, Estero, FL (US)

( * ) Notice: Subject to any disclaimer, the term of this patent is extended or adjusted under 35 U.S.C. 154(b) by 497 days.

(21) Appl. No.: 14/734,899

(22) Filed: Jun. 9, 2015

(65) Prior Publication Data

US 2015/0351992 A1 Dec. 10, 2015

Related U.S. Application Data

(60) Provisional application No. 62/009,383, filed on Jun. 9, 2014.

(51) Int. Cl.

| | |
|---|---|
| ***A61H 1/00*** | (2006.01) |
| ***A61H 1/02*** | (2006.01) |
| ***A61H 5/00*** | (2006.01) |

(52) U.S. Cl.

CPC ... *A61H 1/0237* (2013.01); *A61H 2201/1269* (2013.01); *A61H 2201/164* (2013.01); *A61H 2201/165* (2013.01); *A61H 2201/1635* (2013.01); *A61H 2203/0431* (2013.01)

(58) Field of Classification Search

CPC ... A63B 21/05–21/0557; A63B 21/02–21/028; A63B 21/06–21/068; A63B 23/035–23/03591; A61H 1/0237; A61H 2203/0431; A61H 2201/165; A61H 2201/16; A61H 2201/1269; A61H 2201/164

USPC ..... 482/121–127, 91, 92–96, 79; 601/33–34

See application file for complete search history.

(56) References Cited

U.S. PATENT DOCUMENTS

| | | | | |
|---|---|---|---|---|
| 1,618,273 | A * | 2/1927 | Davidson | A63B 21/0004 482/124 |
| 3,680,869 | A * | 8/1972 | Brady | A63B 69/0059 473/213 |
| 4,495,941 | A | 1/1985 | Rathvon et al. | |
| 4,955,608 | A * | 9/1990 | Dougherty | A63B 21/0552 273/DIG. 19 |
| 5,014,692 | A | 5/1991 | Rhoades | |
| 5,188,365 | A * | 2/1993 | Picard | A63B 69/0059 473/212 |
| 5,228,682 | A * | 7/1993 | Wolf | A63B 69/0071 473/450 |

(Continued)

*Primary Examiner* — Garrett K Atkinson

(74) *Attorney, Agent, or Firm* — Global Intellectual Property Agency, LLC; Daniel Boudwin

(57) ABSTRACT

The present invention provides a leg lifter for those having lower extremity injuries or limited lower extremity strength to facilitate movement. The leg lifter includes a wrapping portion configured to encircle a user's ankle via a fastener. The wrapping portion further includes an adjustable strap that extends outwardly and orthogonally from substantially a midpoint of the wrapping portion. The adjustable strap includes a proximal end and a distal end, wherein the proximal end is affixed to the wrapping portion. The distal end is adapted to be held by a user for lifting the adjustable strap, thus causing the user's lower extremity to be lifted. The distal end further includes a fastener that allows a user to removably attach the distal end to his or her clothing. The adjustable strap is configured to be lengthened or shortened to improve a user's movement and achieve independence from caretakers.

8 Claims, 2 Drawing Sheets

(56) References Cited

U.S. PATENT DOCUMENTS 5,460,385 A * 10/1995 Lazzeroni ..... A63B 69/0095 273/DIG. 19
5,518,486 A * 5/1996 Sheeler ..... A63B 21/0004 482/131
5,545,113 A * 8/1996 Bobich ..... A63B 21/0004 482/124
5,647,827 A * 7/1997 Gutkowski ..... A63B 21/0004 482/122
5,704,856 A * 1/1998 Morse ..... A63B 21/0004 473/212
5,716,307 A * 2/1998 Vadher ..... A43B 7/20 482/124
5,816,952 A * 10/1998 Blevins ..... A63B 69/0071 473/450
5,865,695 A * 2/1999 Mahala ..... A63B 69/0071 473/450
5,911,696 A 6/1999 Coates
6,004,282 A 12/1999 Whitley
6,039,677 A * 3/2000 Spletzer ..... A63B 21/0605 2/22
6,095,936 A * 8/2000 Kirkpatrick ..... A63B 69/0059 434/248
6,428,495 B1 * 8/2002 Lynott ..... A61F 5/3715 128/875
6,755,755 B2 * 6/2004 Wah Loh ..... A63B 69/0059 119/770
6,875,135 B2 * 4/2005 Tracy, Sr. ..... A63B 69/0057 473/422
7,007,705 B1 3/2006 Thrower
7,172,522 B1 * 2/2007 Harvey ..... A63B 69/0071 473/450
7,811,185 B1 * 10/2010 Reynolds ..... A63B 69/0057 473/207
8,852,031 B2 * 10/2014 Williams, Sr. ..... A63B 69/0071 473/450
9,033,855 B2 * 5/2015 Opfer ..... A63B 21/028 482/121
9,162,100 B2 * 10/2015 Rasnake ..... A63B 21/02
2005/0059537 A1 * 3/2005 Hull ..... A63B 21/0004 482/124
2008/0293550 A1 * 11/2008 Campbell ..... A63B 21/0004 482/121

* cited by examiner

LEG LIFTER

CROSS REFERENCE TO RELATED APPLICATION

This application claims the benefit of U.S. Provisional Application No. 62/009,383 filed on Jun. 9, 2014. The above identified patent application is herein incorporated by reference in its entirety to provide continuity of disclosure.

FIELD OF THE INVENTION

The present invention relates to medical devices. Specifically, the present invention relates to a leg lifter that allows a user that is injured, disabled, or elderly to increase his or her mobility without requiring the assistance from caretakers or others. The leg lifter is adapted to be wrapped around a user's lower extremity, wherein an adjustable strap allows a user held by the user to lift the wrapped lower extremity.

BACKGROUND OF THE INVENTION

Often for those that have lower extremity injures or those that have limited lower extremity strength, it is often difficult to maneuver around. Not only do injuries limit mobility, a cast or brace applied to a person's lower extremity further inhibits movement in order to facilitate healing. As a result, many individuals require assistance from others, such as caretakers, to move from one location to another. Everyday activities also require the assistance from others in order to facilitate the same. Therefore, there exists a need for a mobility aid, such as a leg lifter that allows a user to facilitate his or her own movement without the assistance of others.

Leg lifters that allow a user to lift his or her own leg to improve their range of motion by helping lifting a leg and foot onto a wheelchair footrest, a bed, into a car or other locations are disclosed in the prior art. These include devices that have been patented and published in patent application publications. Some of these devices provide a leg lifting device that includes a pair of upper and lower bands secured around a cast and a grasping band for moving the leg. Other devices provide a foot attachment with a strap that enables manipulation of the foot. These devices, however, fail to provide a leg lifter comprising a wrapping portion and an adjustable strap having a clip fastener affixed to the wrapping portion.

The present invention provides a leg lifter that includes a wrapping portion having a first end and a second end configured to encircle a user's ankle via a fastener. Preferably, the fastener is a hook and loop fastener attached to the first end and the second end. The wrapping portion further includes an adjustable strap that extends outwardly and orthogonally from substantially a midpoint of the wrapping portion. The adjustable strap includes a proximal end and a distal end, wherein the proximal end is affixed to the wrapping portion. The distal end is adapted to be held in a user's hand or wrapped around his or her wrist such that the user can raise the adjustable strap in order to move his or her lower extremity. The distal end further includes a clip fastener that allows a user to removably attach the distal end to his or her clothing. In this way, the user can facilitate his own movement to achieve independence from caretakers.

It is therefore submitted that the present invention is substantially divergent in design elements from the prior art, and consequently it is clear that there is a need in the art for an improvement to leg lifting devices. In this regard, the instant invention substantially fulfills these needs.

SUMMARY OF THE INVENTION

In view of the foregoing disadvantages inherent in the known types of leg lifting devices now present in the prior art, the present invention provides a leg lifter wherein the same can be utilized for allowing an injured, disabled, or elderly person to increase his or her mobility to avoid assistance from others.

It is therefore an object of the invention to provide a new and improved leg lifting device that has all of the advantages of the prior art and none of the disadvantages.

Another object of the present invention is to provide a new and improved leg lifting device comprising a wrapping portion having a first end and a second end configured to wrap around a user's ankle and secured thereon via a fastener.

Yet another object of the present invention is to provide a new and improved leg lifting device, comprising a wrapping portion to be disposed around the user's ankle and secured thereon via a hook and loop fastener.

Still yet another object of the present invention is to provide a new and improved leg lifting device, wherein an adjustable strap extends outwardly and orthogonally from substantially a midpoint along the wrapping portion.

An additional object of the present invention is to provide a new and improved leg lifting device, wherein a proximal end of the adjustable strap is affixed to the wrapping portion and a distal end of the adjustable strap includes a clip fastener configured to removably attach to a user's clothing.

A further object of the present invention is to provide a new and improved leg lifter, wherein the adjustable strap includes a slider that allows a user to increase or decrease the length of the adjustable strap to increase his or her mobility and achieve independence.

Still yet another object of the present invention is to provide a new and improved leg lifting device wherein the device may be readily fabricated from materials that permit relative economy and are commensurate with durability.

Other objects, features, and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
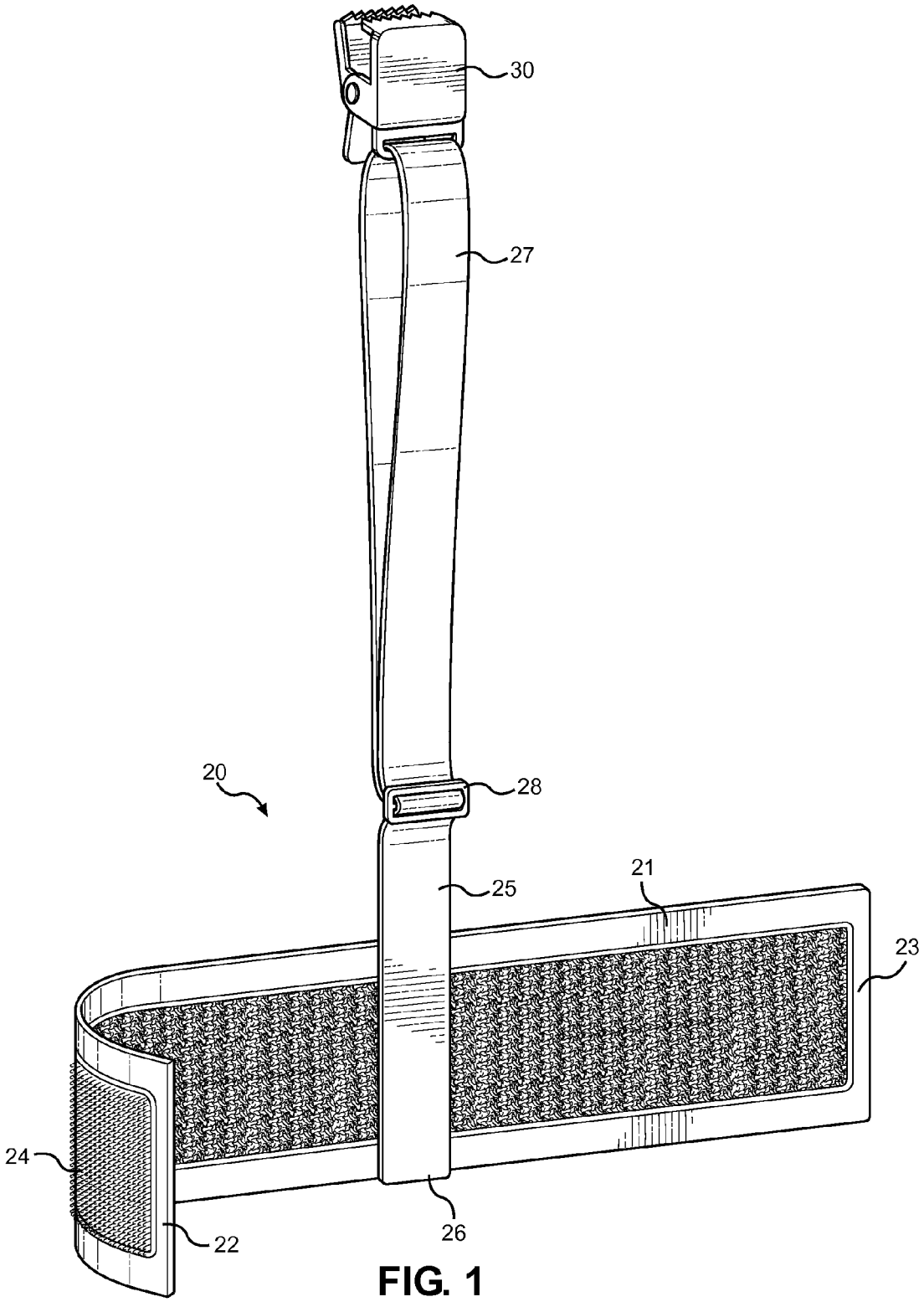
FIG. 1 shows an overhead perspective view of the present invention.

Reference is made herein to the attached drawings. Like reference numerals are used throughout the drawings to depict like or similar elements of the leg lifting device. For the purposes of presenting a brief and clear description of the present invention, the preferred embodiment will be discussed as used for removably attaching to a user's leg to increase mobility without the assistance from others. The figures are intended for representative purposes only and should not be considered to be limiting in any respect.

Figure 2:
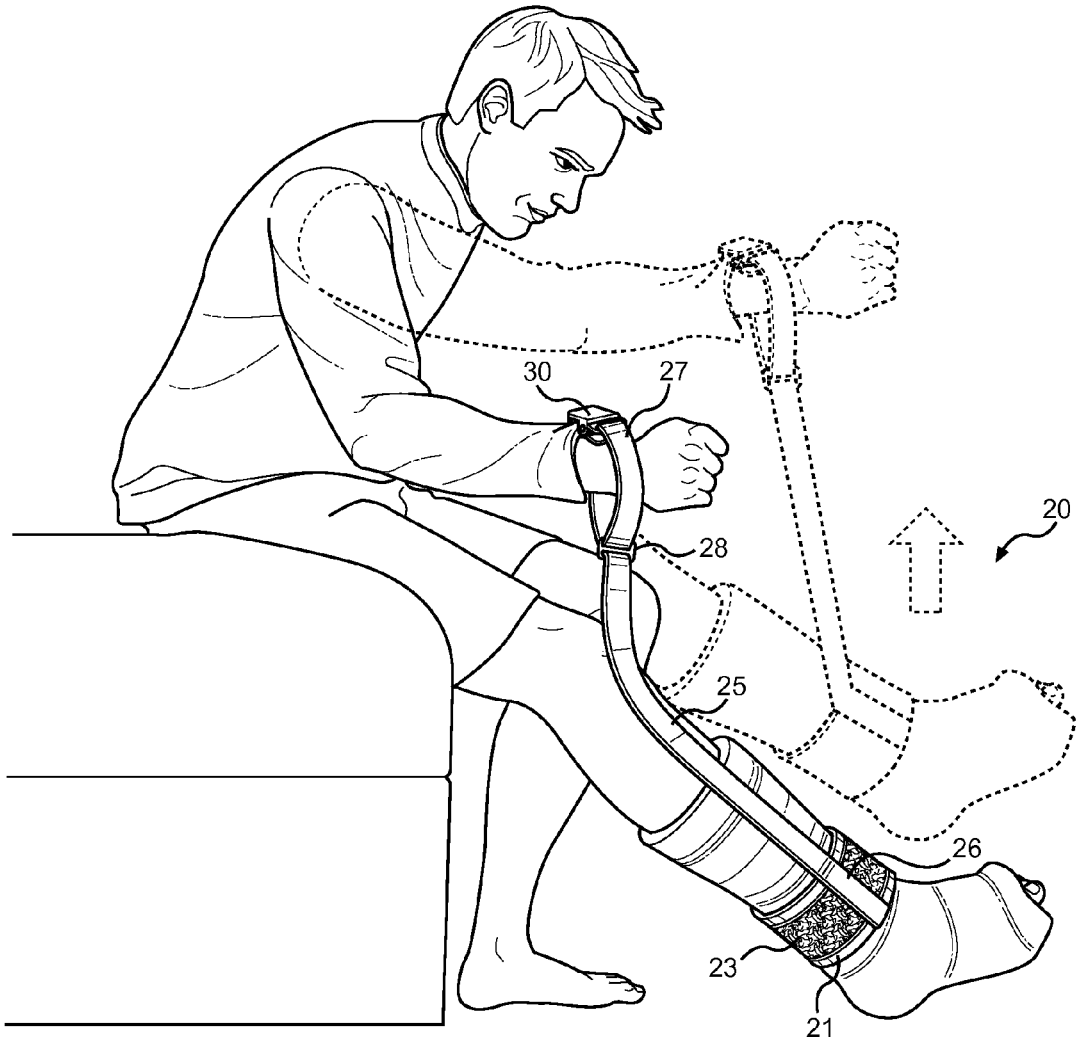
FIG. 2 shows a side perspective view of the present invention.

Referring now to FIGS. 1 and 2, there are shown an overhead perspective view and a side perspective of the leg lifter 20. The leg lifter 20 is configured to wrap around a user's leg to increase independent maneuverability and mobility when injured, disabled, or elderly. In this way, a user does not have to be dependent on a caretaker for mobility. The leg lifter 20 includes a wrapping portion 21 that is configured to wrap around a user's ankle. It is also contemplated that the wrapping portion 21 is configured to encircle other areas along the length of a user's leg.

The wrapping portion 21 is configured to be substantially rectangular in shape, however, other suitable shapes and sizes are likewise contemplated. The wrapping portion 21 includes a first end 22 and the second 23, wherein the first end 22 and the second end 23 are removably attached to one another in an overlapping configuration via a fastener 24 so as to form a loop. Preferably, the fastener 24 is a hook and loop fastener, however, other fasteners such as snap fasteners are suitable and alternatively used in other embodiments. These variations and alterations are deemed within the scope and spirit of the present invention and likewise contemplated. Furthermore, the wrapping portion 21 is composed from an elastic fabric, like cotton, polyester or a combination thereof, however, other suitable materials are alternatively used in other embodiments.

An adjustable strap 25 is permanently affixed to a midpoint of the wrapping portion 21. Preferably, the adjustable strap 25 extends outwardly and orthogonally in relation to the wrapping portion 21. The adjustable strap 25 includes a proximal end 26 and a distal end 27, wherein the proximal end 26 is affixed to the wrapping portion 21. Preferably, the proximal end 26 is sewn onto the wrapping portion 21, however, in other embodiments, the proximal end 26 is affixed to the wrapping portion by other means, such as an adhesive.

The adjustable strap 25 includes a slider 28 that allows for the adjustable strap 25 to be lengthened or shortened. The slider 28, as illustrated as an exemplar, includes a frame with a central bar and a pair of parallel slots, wherein the pair of parallel slots are on either side of the bar. One end of the adjustable strap 25 may be fixed onto the central bar, while the adjustable portion of the adjustable strap 25 passes through one slot over the central bar, and then through the other slot. Movement of the slider 28 along the adjustable strap 25 allows the adjustable strap 25 to alter the effective length of the adjustable strap 25.

The distal end 27 of the adjustable strap 25 is configured to loop around a user's wrist so as to use the adjustable strap 25 to lift his lower extremity encircled by said wrapping portion 21. The distal end 27 includes a fastener, preferably a clip 30, which is configured to removably attach to a user's clothing. Preferably, the clip is removably attached to a wrist cuff of a user's shirt to prevent the distal end 27 from being easily unfastened while in use. In this way, the distal end 27 is adapted to be held in a user's hand or wrapped around his or her wrist in a loop such that the user can raise the adjustable strap in order to move his or her lower extremity.

Thereafter, the adjustable strap 25 can be lengthened or shortened to allow a user to raise or lower his leg without requiring assistance from others by manually lifting the adjustable strap 25 by the use of his hands. It is contemplated that the user can improve his own mobility and maneuverability, thereby achieving independence. Preferably, the clip 30 is a clip fastener, such as a clip used with suspenders, however, other suitable clip fasteners or clamp fasteners are likewise contemplated. Furthermore, the clip 30 is also configured to be removably attached to an upper end of a user's leg cast or brace. In this way, the adjustable strap 25 can be generally stored when unneeded.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A leg lifter, comprising:

a wrapping portion configured to form a closed loop around a user's lower extremity and be removably secured to said user's lower extremity via a fastener, said wrapping portion comprising a central portion and a perimeter portion extending from the central portion, wherein a fastener is disposed entirely on the central portion;

the perimeter portion entirely encompassing the central portion, and extending inward from an edge a uniform distance from the central portion on a first side;

an adjustable strap attached to said wrapping portion having a proximal end and a distal end, said proximal end attached to a midpoint of said wrapping portion and disposed orthogonally to said wrapping portion, said adjustable strap including a slider and a clip slidably disposed on the wrapping portion, having opposing jaws disposed on said distal end, said adjustable strap forming a closed loop disposed between said slider and said clip, said slider configured to adjust a diameter of the closed loop, said closed loop including an opening disposed in a plane transverse to a plane in which said wrapping portion is disposed;

each said opposing jaws of said clip having a plurality of interlocking teeth thereon;

said closed loop on the adjustable strap configured to receive a user's wrist forming the closed loop around the wrist and facilitating lifting of said user's lower extremity encircled by said wrapping portion.

2. The leg lifter of claim 1, wherein said slider is configured to allow said adjustable strap to be lengthened or shortened.

3. The leg lifter of claim 2, wherein:

said slider includes a frame with a central bar and a pair of parallel slots;

wherein said pair of parallel slots are disposed on either side of said bar.

4. The leg lifter of claim 1, wherein said wrapping portion includes a first end and a second end removably attached to one another in an overlapping configuration via said fastener so as to form the closed loop.

5. The leg lifter of claim 1, wherein said fastener of said wrapping portion includes a hook and loop fastener.

6. The leg lifter of claim 1, wherein said wrapping portion is rectangular in shape.

7. The leg lifter of claim 1, wherein said wrapping portion is composed from elastic fabric.

8. The leg lifter of claim 1, wherein the clip comprises a U - shape having a rigid material and configured to removably attach to a user's clothing.

* * * * *